US009758341B2

(12) United States Patent
Troitzsch

(10) Patent No.: US 9,758,341 B2
(45) Date of Patent: Sep. 12, 2017

(54) BOBBIN CHANGING DEVICE

(71) Applicant: Maschinenfabrik NIEHOFF GmbH & Co. KG, Schwabach (DE)

(72) Inventor: Steffen Troitzsch, Neuenbürg-Waldrennach (DE)

(73) Assignee: Maschinenfabrik NIEHOFF GmbH & Co. KG, Schwabach (DE)

( * ) Notice: Subject to any disclaimer, the term of this patent is extended or adjusted under 35 U.S.C. 154(b) by 0 days.

(21) Appl. No.: 14/370,866

(22) PCT Filed: Jan. 10, 2013

(86) PCT No.: PCT/EP2013/000060

§ 371 (c)(1),
(2) Date: Jul. 7, 2014

(87) PCT Pub. No.: WO2013/135329

PCT Pub. Date: Sep. 19, 2013

(65) Prior Publication Data

US 2015/0016927 A1 Jan. 15, 2015

(30) Foreign Application Priority Data

Mar. 16, 2012 (DE) ..... 10 2012 005 374

(51) Int. Cl.
*B65H 1/00* (2006.01)
*B65H 67/02* (2006.01)
(Continued)

(52) U.S. Cl.
CPC ..... *B65H 67/02* (2013.01); *B65H 67/0405* (2013.01); *B65H 67/0411* (2013.01);
(Continued)

(58) Field of Classification Search
CPC ..... B25J 18/025; B25J 9/041; B23Q 7/04; D01H 4/50; B65H 67/02; B65H 67/0411;
(Continued)

(56) References Cited

U.S. PATENT DOCUMENTS 3,813,866 A * 6/1974 Goldammer ..... D01H 9/001 294/86.4
4,015,786 A * 4/1977 Slavik et al. ..... 242/473.6
(Continued)

FOREIGN PATENT DOCUMENTS

CN 1082505 A 2/1994
DE 4137935 A1 5/1992
(Continued)

OTHER PUBLICATIONS

International Search Report, PCT/EP2013/000060, "Bobbin Changing Device," filed Jan. 10, 2013, date of mailing Apr. 18, 2013.
(Continued)

*Primary Examiner* — Stephen Vu
(74) *Attorney, Agent, or Firm* — Hamilton, Brook, Smith & Reynolds, P.C.

(57) ABSTRACT

A bobbin changing device for feeding bobbins to and/or removing bobbins from a processing device which can wind a strand-form material onto a bobbin and/or from a bobbin, wherein the bobbin changing device has at least one conveyor device, wherein the bobbin changing device has a swivel fork which is suited for feeding bobbins to and/or removing bobbins from such a processing device and for feeding bobbins to and/or removing bobbins from the conveyor device.

10 Claims, 4 Drawing Sheets

(51) Int. Cl.
*B65H 67/04* (2006.01)
*B65H 67/06* (2006.01)

(52) U.S. Cl.
CPC ..... *B65H 67/0417* (2013.01); *B65H 67/064* (2013.01); *B65H 2701/35* (2013.01)

(58) Field of Classification Search
CPC ..... B65H 67/0417; B65H 2701/31; B65H 67/0405; B65H 67/064; B65H 2701/35
See application file for complete search history.

(56) References Cited

U.S. PATENT DOCUMENTS 4,085,900 A * 4/1978 Marcio' ..... 242/473.6
4,125,990 A * 11/1978 Stahlecker et al. ..... 57/263
4,178,748 A * 12/1979 Stahlecker et al. ..... 57/263
4,335,859 A * 6/1982 Courvoisier ..... 242/473.7
4,651,865 A 3/1987 Kupper et al.
4,775,271 A * 10/1988 Maccaferri ..... B65H 67/04 242/473.4
5,035,571 A 7/1991 Raasch
5,226,778 A 7/1993 Sekitani
5,393,003 A * 2/1995 Watermann ..... 242/473.6
5,544,828 A 8/1996 Winkler et al.

FOREIGN PATENT DOCUMENTS

DE 4125383 A1 2/1993
FR 2853332 A1 10/2004
GB 2169626 A 7/1986
JP H07-504877 6/1995

OTHER PUBLICATIONS

English translation of International Preliminary Report on Patentability and Written Opinion, PCT/EP2013/000060, "Bobbin Changing Device," date of mailing Sep. 25, 2014.

* cited by examiner

BOBBIN CHANGING DEVICE

This application is the U.S. National Stage of International Application No. PCT/EP2013/000060, filed Jan. 10, 2013, which designates the U.S., published in German, and claims priority under 35 U.S.C. 119 or 365(c) to German Application No. DE 102012005374.6, filed Mar. 16, 2012. The entire teachings of the above applications are incorporated herein by reference.

The present invention relates to a bobbin changing device for feeding bobbins to and/or removing bobbins from a processing device which can wind a strand-like material onto a bobbin and/or from a bobbin.

Here, the strand-like material can for instance be a fiber, a thread, a rope, a wire, a lace or a single-core or a multi-core cable.

In a first application case, the processing device is a manufacturing machine for such a strand-like material, as for instance a wire drawing machine or a spinning machine, In this case, an empty bobbin onto which the processing device winds the manufactured strand-like material, for example the spun thread or the drawn wire, is fed to the processing device. Then the full bobbin is taken out of the processing device and is exchanged against a new, empty bobbin.

In a second application case, the processing device is a machine for further processing such a strand-like material, as for instance a twisting machine or a machine for manufacturing multi-core cables from single laces. In this case, a full bobbin onto which the strand-like material, for instance a thread or a lace, is wound and from which it is wound and processed by the processing device is fed to the processing device. Then the empty bobbin is taken out of the processing device and is exchanged against the new, full bobbin.

As the machine for further processing in the second application case simultaneously functions as a manufacturing machine like in the first application case, it is also possible in the second application case to deploy two bobbin changing devices (one with the bobbin changing function described for the first application case and one with the bobbin changing function described for the second application case) simultaneously.

By a bobbin, in this context a preferably rotationally symmetrical body is understood which preferably has a cylindrical or a conical bobbin body and preferably disk-like flanges which are arranged at either end of the bobbin body, the diameter of the two flanges in general being substantially larger than the largest diameter of the bobbin body. In the context of the present invention, it is assumed that all bobbins which are used with the bobbin changing device have the same flange diameter, preferably a standard diameter of 400 mm. As opposed to this, the bobbin height can be—within the limits of the bobbin sizes which are handable by the processing device—arbitrarily large.

Here, the bobbin body serves as a winding core for winding the strand-like material to and from the bobbin, with the two flanges preventing the windings of the strand-like material from slipping off the two ends of the bobbin body. In the present patent application, the term bobbin denotes a fully wound, a partially wound and also an empty bobbin.

The processing device has a so-called spooling site. By this term, a fixedly predetermined position at or in the processing device is understood onto which a bobbin can be placed and in which the winding of the strand-like material onto or from the bobbin by the processing device is possible. Here, the bobbin is in general placed onto the spooling site in such a way that the rotational axis of the bobbin is substantially oriented vertically. In this position and orientation at or in the processing device, the bobbin is seized by a suitable mechanism of the processing device, which for instance has one pin each engaging at the top and at the bottom into a hollow axis of the bobbin for centering the bobbin and is rotated in order to wind the strand-like material onto the bobbin or from the bobbin. It is evident that also other orientations of the bobbin on the spooling site are possible, for example with a horizontal or an inclined rotational axis.

The feeding and/or removing of bobbins to or from the processing device is carried out by a bobbin changing device. By a bobbin changing device in the sense of the present invention, a mechanical device is understood which is suited for feeding and/or removing bobbins to or from a processing device. The bobbin changing device has a conveyor device and a handover device.

By a conveyor device in the sense of the present invention, a device is understood which is suitable for moving bobbins in an arbitrary filling state, i.e. full bobbins, empty bobbins, or bobbins which are partially filled with the strand-like material, to or away from the processing device. A conveyor device preferably has at least one conveyor belt. Particularly preferably, the conveyor device has two conveyor belts, one of which is preferably adapted for bringing full or empty bobbins and the other one for taking away the empty or full bobbins, respectively.

The conveyor belts, in turn, are loaded for instance by automatic handling devices like industrial robots, but also by human operating staff, taking for example full bobbins from a warehouse or from a pallet and placing them onto the one conveyor belt and/or taking empty bobbins from the other conveyor belt and placing them onto a pallet or taking them to a warehouse.

By a handover device in the sense of the present invention, a mechanical device is understood which hands the bobbins over between the processing device and the conveyor device, i.e. which is suited for feeding and/or removing the bobbins both to or from the processing device and to or from the conveyor device. The handover device thus serves as an "interface" between the conveyor device and the processing device.

The handover device and/or the conveyor device can for instance be driven electrically, hydraulically, and/or pneumatically.

There are different known types of bobbin changing devices:

For example, the conveyor device of the bobbin changing device can consist of two parallel roller conveyor belts on which the bobbins are brought or taken away while they are standing on their flanges. Here, the two conveyor belts have a distance from each other which is somewhat larger than the diameter of a bobbin flange. The two conveyor belts are connected to each other at their ends facing the processing device by a transverse chain conveyor with two revolving chains. Here, the two chains of the transverse chain conveyor are running orthogonally to the running direction of the conveyor belts, so that the two conveyor belts and the traverse chain conveyor together form a U-like arrangement. The chains of the traverse chain conveyor are oriented in parallel to the rollers of the conveyor belts, and each of them is running between adjacent rollers of a conveyor belt.

When a bobbin is positioned at the end of the first conveyor belt, the traverse chain conveyor is lifted in order to pick the bobbin up and to move it orthogonally to the conveyor belts to a position between the two conveyor belts directly facing the spooling site of the processing device. This position is called the handover position of the conveyor device.

In this case, a four-armed gripper unit is arranged as a handover device of the bobbin changing device in the middle between the handover position and the spooling site of the processing device. Therein, two gripping arms which are rotatably mounted together form a pair of tongs each which are able to seize a bobbin on the spooling site of the processing device or on the handover position of the conveyor device, the four gripping arms being connected to each other by a gear transmission and thus being synchronized in their movements.

The gripper unit as a whole is rotatable about a vertical axis and can both be lifted and lowered. As soon as two bobbins on the spooling site of the processing device and on the handover position of the conveyor device have been seized, the gripper unit as a whole is lifted, turned by 180 degrees and lowered again, causing the two bobbins to change their places. Then the gripper arms are opened, so that the bobbin now standing on the spooling site of the processing device can be used in the processing action, and the bobbin now standing on the handover position of the conveyor device can now be conveyed to the second conveyor belt by the transverse chain conveyor. At last, the transverse chain conveyor is lowered again, so that the bobbin can be moved away on the second conveyor belt.

Other bobbin changing devices from the prior art, for instance from DE 41 25 383 A1, provide a turntable providing several standing positions for the bobbins as a handover device of the bobbin changing device.

The known solutions described above are on the one hand mechanically very complex and on the other hand require long driving distances of the bobbins when the bobbins are changed, leading to a relatively long period during which no bobbin is standing on the spooling site of the processing device, altogether resulting in a relatively long idle time of the processing device and a corresponding loss in productivity.

It is therefore the object of the present invention to provide a mechanically simply designed and thus low-cost bobbin changing device as well as a processing facility with such a bobbin changing device and a method for operating such a bobbin changing device.

By a processing facility, in this context a facility is understood having a processing device and a bobbin changing device in the sense of the present invention, the bobbin changing device feeding bobbins to the processing device and/or removing bobbins from the processing device.

This problem is solved by the bobbin changing device according to claim 1, by the processing facility according to claim 12 and by the bobbin changing method according to claim 13. Advantageous further developments of the invention are contained in the subclaims.

A bobbin changing device according to the invention for feeding and/or removing bobbins to or from a processing device which can wind a strand-like material onto a bobbin and/or from a bobbin has at least one conveyor device, in particular a conveyor belt, and a swivel fork which is suited for feeding and/or removing bobbins to or from the processing device and for feeding and/or removing bobbins to or from the conveyor device. The swivel fork according to the invention thus realizes the handover device described above.

By a swivel fork in the sense of the present invention, a rigid component with at least two bar-like elements which are open at their ends (the "prongs" of the fork) is understood which can be swiveled, i.e. rotated by a limited or unlimited angle in one or both directions, about at least one axis.

A swivel fork enables—as opposed to the gripper unit used in the prior art in connection with a transverse chain conveyor—a particularly simple design of the bobbin changing device without a plurality of interacting, movable components, and thus correspondingly low manufacturing costs.

Preferably, the swivel fork can be swiveled about a swivel axis which is oriented substantially vertically. This enables a design of the bobbin changing device which is oriented horizontally to a large extent, wherein the swivel fork, provided it extends orthogonally to the swivel axis, is always oriented in parallel to the floor.

In a particularly preferred embodiment, at least one bobbin receiving site is formed on the swivel fork on which a bobbin can stand in such a way that the bobbin follows a swivel movement of the swivel fork about the swivel axis.

This arrangement where the bobbin can stand on the swivel fork without further holding devices and can be swiveled in this way, makes it possible to do without such holding devices, as for instance the gripping arms used in the prior art with their complex mechanisms and the adjustment effort connected thereto for adjusting a proper contact pressure which always remains constant.

In a preferred embodiment, at least two bobbin receiving sites are formed on the swivel fork. If these two bobbin receiving sites are positioned close to each other on the peripheral direction of the swivel fork, this results in particularly short driving distances and thus short bobbin changing times, when a first bobbin is to be picked up from the spooling site of the processing device onto a first bobbin receiving site of the swivel fork and immediately afterwards a second bobbin is to be put down from a second bobbin receiving site of the swivel fork to the spooling site of the processing device.

In a further particularly preferred embodiment, the at least one bobbin receiving site is formed by two elements of the swivel fork spaced apart from each other.

Here, the two elements spaced apart from each other can be the "prongs" of the swivel fork. By this design, the elements which are necessary for forming the bobbin receiving site are largely reduced in their form, for example compared to a planar bobbin receiving site on a turntable. This leads to material savings and to a reduction of the accelerated mass of the bobbin changing device and thus enables higher swiveling velocities of the swivel fork and thus shorter bobbin changing times. Furthermore, the bobbin receiving site can be realized in an "open" design in this way, whereby collisions with other components of the bobbin changing device and/or of the processing device can be avoided.

In a further preferred embodiment, the swivel fork can be positioned relative to the processing device in such a way that the at least one bobbin receiving site can substantially be matched with the spooling site of the processing device in a vertical projection by swiveling a swivel fork.

In a further preferred embodiment, at least one bobbin storage site is formed in the area of the conveyor device on which the bobbin can stand, the conveyor device being able to move a bobbin to the bobbin storage site and/or to move a bobbin away from the bobbin storage site.

In a further preferred embodiment, the at least one bobbin receiving site of the swivel fork can substantially be matched with at least one bobbin storage site of the conveyor device in a vertical projection by swiveling the swivel fork.

By this arrangement of the spooling site of the processing device, the at least one bobbin receiving site of the swivel fork, and the at least one bobbin storage site of the conveyor device relative to each other, all functional prerequisites for an efficient handover of the bobbins between these positions are provided. In this way, further mechanical components like the transverse chain conveyor used in the prior art can be dispensed with, which also results in a more compact design of the conveyor device, preferably with conveyor belts lying closely next to each other.

Furthermore, the arrangement of the spooling site of the processing device and of the at least one bobbin storage site of the conveyor device relative to the at least one bobbin receiving site of the swivel fork are freely choosable, provided they have the same radial distance from the rotational axis of the swivel fork. In particular, an arrangement in which the spooling site of the processing device and a handover position of the conveyor device directly face each other is not necessary any more.

In a further preferred embodiment, the vertical position of the swivel fork can be changed. Particularly preferably, the swivel fork can be moved into at least one lower, one middle and one upper height position. More preferably, a continuous vertical movement of the swivel fork over a certain height range is possible.

Lifting the swivel fork enables to pick a bobbin up from a bobbin storage site of the conveyor device and/or from the spooling site of the processing device to a bobbin receiving site of the swivel fork in a simple way, provided the swivel fork is positioned beneath the bobbin storage site or the spooling site, respectively, and is matched therewith to a large extent.

Correspondingly, lowering the swivel fork enables to put a bobbin down from a bobbin receiving site of the swivel fork to a bobbin storage site of the conveyor device and/or to the spooling site of the processing device in a simple way, provided the swivel fork is positioned above the bobbin storage site or the spooling site, respectively, and is matched therewith to a large extent.

In a particularly preferred embodiment, at least in the lowermost height position of the swivel fork, the surface of the at least one bobbin receiving site of the swivel fork is at the same height or below the surface of the conveyor device.

This makes it possible that the swivel fork can be swiveled below the bobbin storage site of the conveyor device towards this bobbin storage site in order to pick a bobbin up there by lifting the swivel fork, and/or that a bobbin can be put down there by lowering the swivel fork and the swivel fork can be swiveled away from the bobbin storage site of the conveyor device below this bobbin storage site.

In a particularly preferred embodiment, the conveyor device and the movement space of the swivel fork at least partially interpenetrate each other. By a movement space of the swivel fork, in this context the volume is understood in which some point of the swivel fork can lie over all possible swiveling positions in connection with all possible height positions of the swivel fork.

Preferably, such an interpenetration is enabled by corresponding recesses in the conveyor device, in which case the mentioned "open" design of the swivel fork turns out to be particularly advantageous, as the volume of the recesses can be largely minimized in this way.

The swiveling of the swivel fork under the bobbin storage site of the conveyor device as described above is realized in a simple way by the mutual interpenetration of the conveyor device and the movement space of the swivel fork, where at the same time it is guaranteed that the bobbin can be picked up and/or put down safely from or onto the bobbin storage site.

Furthermore, a subject-matter of the invention is a processing facility for processing a strand-like material having a processing device of the mentioned type and a bobbin changing device according to the invention. Such a processing facility allows for the fully automatic handling of the bobbins at the processing device, in particular of the feeding and removing of the bobbins, i.e. of the bobbin change.

A subject-matter of the invention is also a bobbin changing method to be executed on a processing facility according to the invention for feeding bobbins to or removing bobbins from a processing device of the mentioned type. The bobbin changing method has a number of basic operations which are provided by the mechanical drives of the components of the bobbin changing device and can be combined in an arbitrary order and/or in an arbitrary number of repetitions by programmable controls, taking into account the configuration of the processing facility and in line with the particular requirements to the operation thereof.

The set of these basic operations comprises, but not necessarily exclusively, the operations: moving the conveyor device towards a bobbin storage site of the conveyor device by a certain distance, moving the conveyor device away from a bobbin storage site of the conveyor device by a certain distance, swiveling the swivel fork about the swiveling axis by a certain angle in a certain direction, lifting the swivel fork by a certain distance, lowering the swivel fork by a certain distance.

From these basic operations, possibly using further information, for example from sensors for the positions or filling states of bobbins or about the state of the processing device, an operating program for the operation of the processing facility can then be assembled which can run on the processing facility while being controlled by the programmable control.

Further advantages, features and application possibilities of the present invention will be apparent from the subsequent description in connection with the figures, showing:

Figure 1:
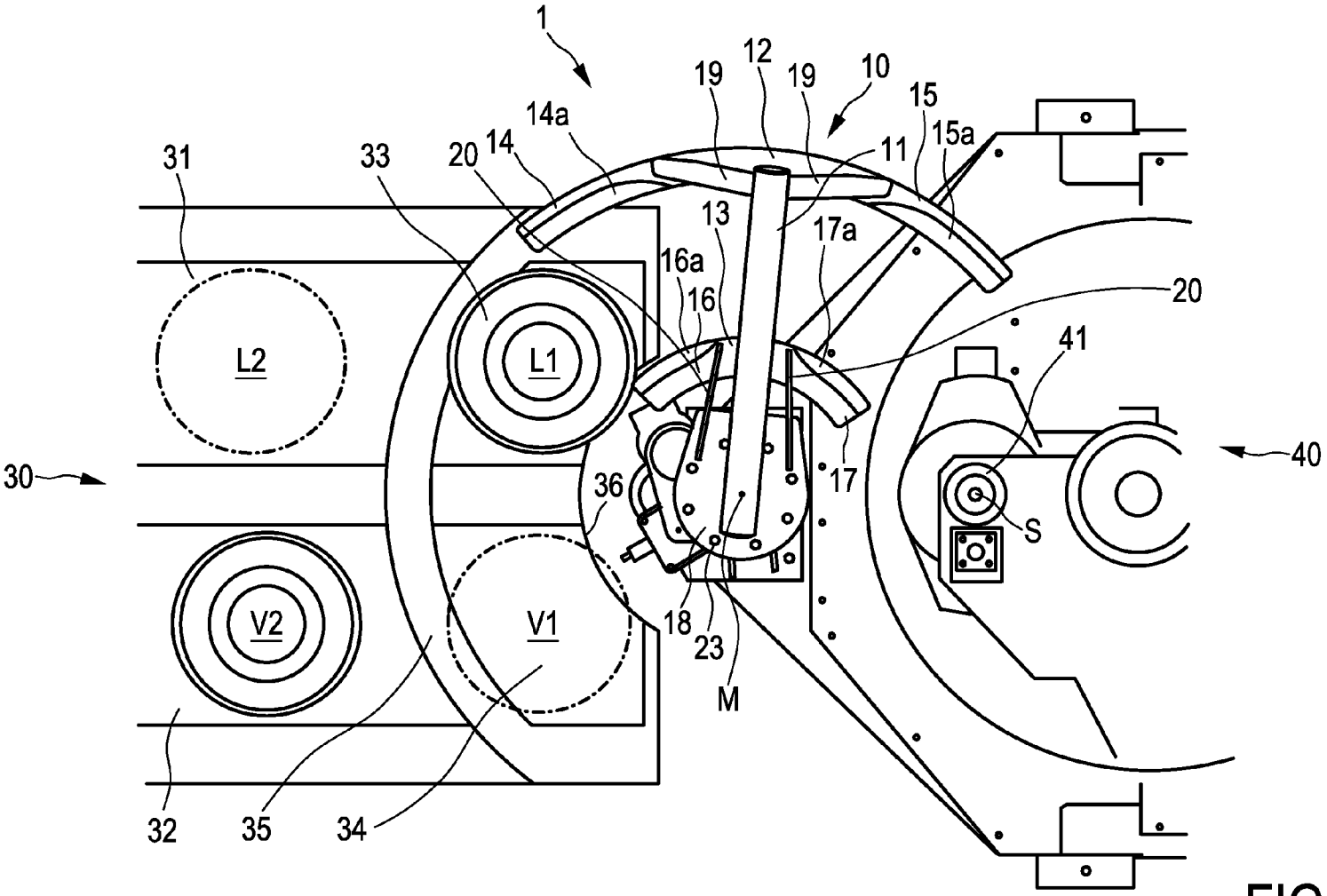
FIG. 1 is a top view onto a bobbin changing device according to the invention.
Figure 4:
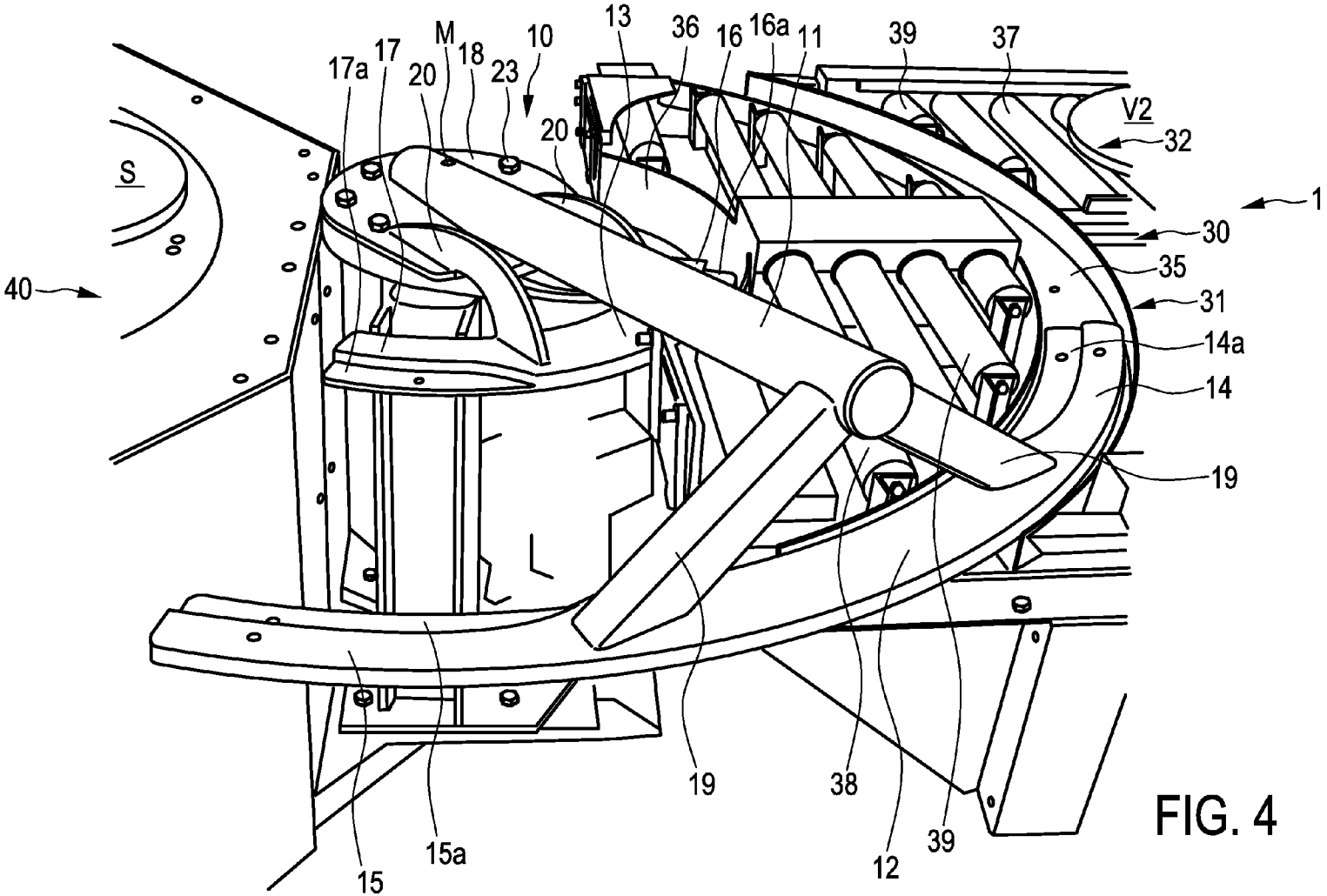
FIG. 4 is a perspective view of a bobbin changing device according to the invention.

In the top view in FIG. 1 onto a bobbin changing device 1 according to the invention, the conveyor device 30 can be seen at the left, the swivel fork 10 in the middle and the processing device 40 at the right. A detail from the bobbin changing device according to the invention is again shown as a perspective view in FIG. 4.

The processing device 40 is, for instance, a manufacturing machine for a cable which is produced in the processing device 40 and is wound onto a bobbin S which is placed on the spooling site 41 and is rotatably mounted there. Correspondingly, the task of the bobbin changing device 1 is to feed empty bobbins L1, L2 to the processing device 40 and to remove full bobbins V1, V2 therefrom.

The conveyor device 30 has two conveyor belts, namely the empty bobbin belt 31 for bringing empty bobbins L1, L2 and the full bobbin belt 32 for taking full bobbins V1, V2 away.

The two conveyor belts 31, 32 are roller conveyor belts with rollers 37 arranged orthogonally to the conveying direction. One part of rollers 37 is driven by electric motors, whereas another part of rollers 37 is not driven. Furthermore, some rollers 38 are rubberized in order to guarantee an increased static friction of the bobbins when they are moved on the rollers 38. In particular, those rollers 38 are rubberized on which the bobbins are heavily accelerated and/or decelerated. On both conveyor belts 31, 32, the bobbins are moved while they are standing vertically on their flanges.

At the right end of the empty bobbin belt 31, the empty bobbin storage site 33 is located, on which the empty bobbin L1 is standing in FIG. 1. At the right end of the full bobbin belt 32, the full bobbin storage site 34 is located, on which the full bobbin V1 is standing in FIG. 1. In this configuration of conveyor device 30, empty bobbin belt 31 only moves to the right, and full bobbin belt 32 correspondingly only moves to the left.

Swivel fork 10 can freely be swiveled about a vertical swivel axis going through the pivot M, in both directions. It can be positioned with high precision, for example with a resolution of ±0.04 degrees, with the current angular position being measured by an absolute value sensor device. The rotational movement of the swivel fork is done via a geared motor.

Furthermore, swivel fork 10 can be moved into three defined height positions BOTTOM, MIDDLE and TOP via a combination of two lifting cylinders. Here, the position BOTTOM is below the surface of conveyor belts 31, 32, the position TOP is above the spooling site 41, and the position MIDDLE is about in the middle between the positions TOP and BOTTOM.

Substantially, swivel fork 10 has the following components

- a fork shaft 11 in the form of a tube, for example with a round cross section, which is arranged horizontally or nearly horizontally and substantially extends, with respect to the pivot M, on one side in radial direction,
- an outer fork bow 12 and an inner fork bow 13 in the form of curved tubes, for example with a rectangular cross section, with a constant curvature and with an even upper side, extending on two horizontally arranged circles with pivot M as their centers over the same arc, the two circles lying in the same plane, but below fork shaft 11, and the radius of outer fork bow 12 being larger than the radius of inner fork bow 13,
- a horizontally arranged fork mounting plate 18, to which fork shaft 11 is connected, preferably welded,
- two outer fork bow fixing bars 19 which are connected, preferably welded, to fork shaft 11 at their ends facing fork shaft 11 and to outer fork bow 12 at their ends opposite fork shaft 11,
- two inner fork bow fixing bars 20 which are connected, preferably welded, to the fork fixing plate 18 at their radially inner ends and to inner fork bow 13 at their radially outer ends. Alternatively, inner fork bow fixing bars 20 can also be connected, preferably welded, to fork shaft 11.

Hence, fork mounting plate 18, outer fork bow 12 and inner fork bow 13 are arranged horizontally, outer fork bow 12 and inner fork bow 13 being positioned below fork shaft 11. Here, inner and outer fork bow fixing bars 19, 20 are the connections between the two height levels.

Fork fixing plate 18 is screwed to a rotary bearing (not shown) positioned underneath, preferably a ball, needle, or roller bearing or a friction bearing, which enables the rotation around pivot M, by a plurality of screws 23. The swivel drive of swivel fork 10 is done via an electric geared motor (not shown). Swivel fork 10 is mounted on a column-like basic frame (not shown).

Fork shaft 11 divides—in a vertical projection of the swivel fork, as shown in FIG. 1—each of outer fork bow 12 and inner fork bow 13 into—seen radially outwardly—an outer left fork section 14 and an inner left fork section 16 which are located left of fork shaft 11, and an outer right fork section 15 and an inner right fork section 17 which are located right of fork shaft 11, outer left and outer right fork sections 14 and 15 being approximately equally long and inner left and inner right fork sections 16 and 17 being approximately equally long.

Outer left and inner left fork sections 14 and 16 together form a left bobbin receiving site 21 on the swivel fork, and outer right and inner right fork sections 15 and 17 together form a right bobbin receiving site 22 on the swivel fork. On either bobbin receiving site 21, 22, a bobbin can stand in such a way that it follows a swiveling movement of the swivel fork 10 about the swivel axis. Here, the lower flange of the bobbin is engaged at two parts of its circumference facing each other by the two left fork sections 14 and 16 or by the two right fork sections 15 and 17, which are forming the respective bobbin receiving site 21, 22.

Figure 2:
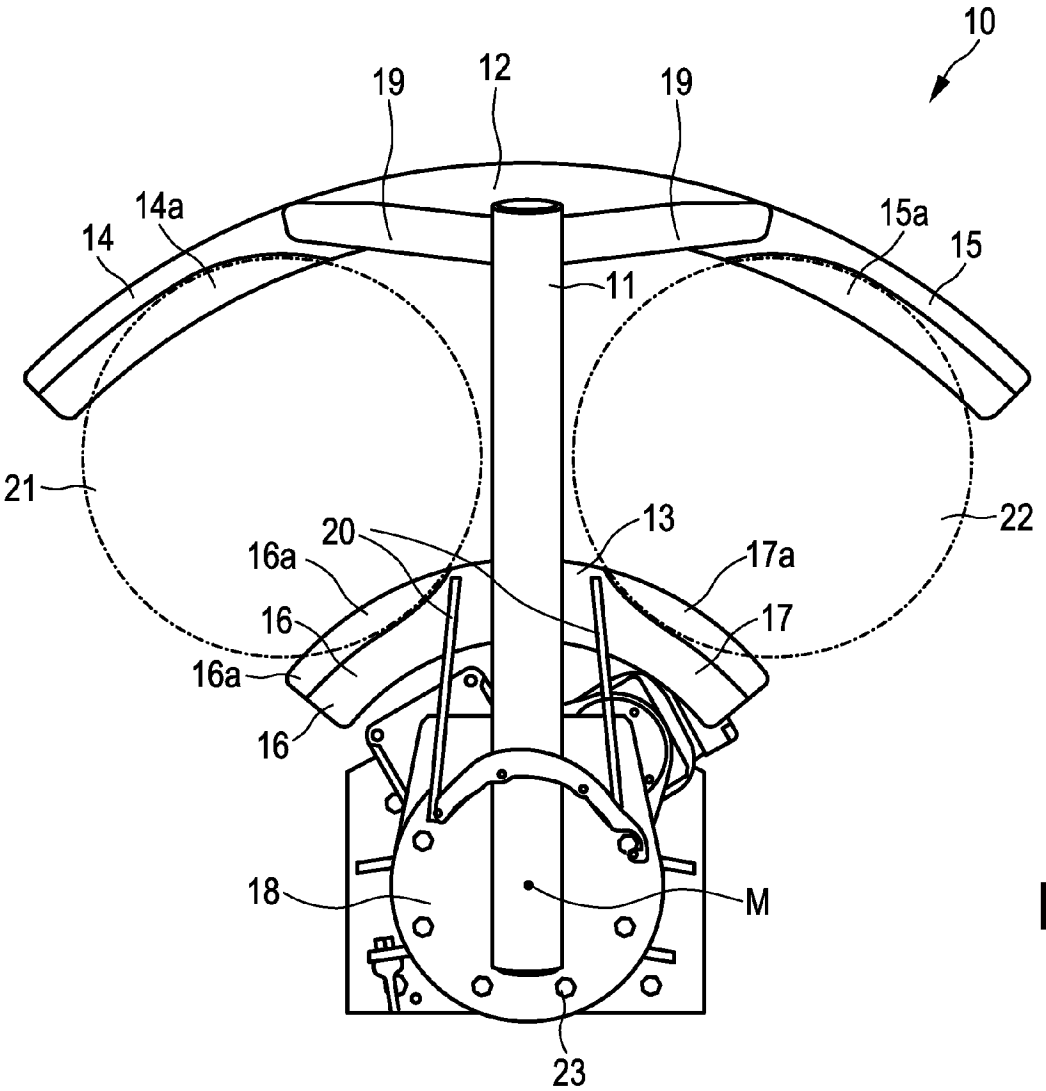
FIG. 2 is a top view onto a swivel fork according to the invention.

The exact position of left bobbin receiving site 21 and of right bobbin receiving site 22 is apparent from the isolated view of the swivel fork as a top view in FIG. 2.

In order to prevent the bobbin from slipping off a bobbin receiving site, the surface of fork sections 14, 16 or 15, 17 can be provided with an anti-slip coating. Additionally or alternatively, fork sections 14, 16 or 15, 17 can also, as shown in FIG. 1, be provided with recesses 14*a*, 16*a* or 15*a*, 17*a* which are lying more below and on which the bobbin flange rests, while the remaining components of fork section 14,16 or 15,17 which are lying more above form a radially inward or radially outward stop for the bobbin flange.

The two conveyor belts 31, 32 are broken through in the area of empty bobbin storage site 33 and full bobbin storage site 34. In the breakthrough, an arc-like groove 35 is arranged which runs concentrically to pivot M of swivel fork 10 and whose radial extension is somewhat larger than the radial extension of outer fork bow 12 of swivel fork 10. Also, the ground of groove 35 is located somewhat deeper than the bottom side of outer fork bow 12 when swivel fork 10 is in the height position BOTTOM. In this way, outer fork bow 12 can pass groove 35 when swivel fork 10 is swiveled without touching it or colliding with any other component.

Furthermore, the two conveyor belts 31, 32 have a recess in the area of empty bobbin storage site 33 and full bobbin storage site 34. In the recess, an arc-like shielding plate 36 for inner fork bow 13 of swivel fork 10 is arranged. Shielding plate 36 also runs concentrically to pivot M of swivel fork 10. The radius of shielding plate 36 is somewhat larger than the outer radius of inner fork bow 13. Thus, inner fork bow 13 can pass inside shielding plate 36 when swivel fork 10 is swiveled without touching shielding plate 36 or colliding with any other component.

Groove 35 and shielding plate 36 also largely prevent foreign matter from entering the movement space of swivel fork 10.

Figure 3:
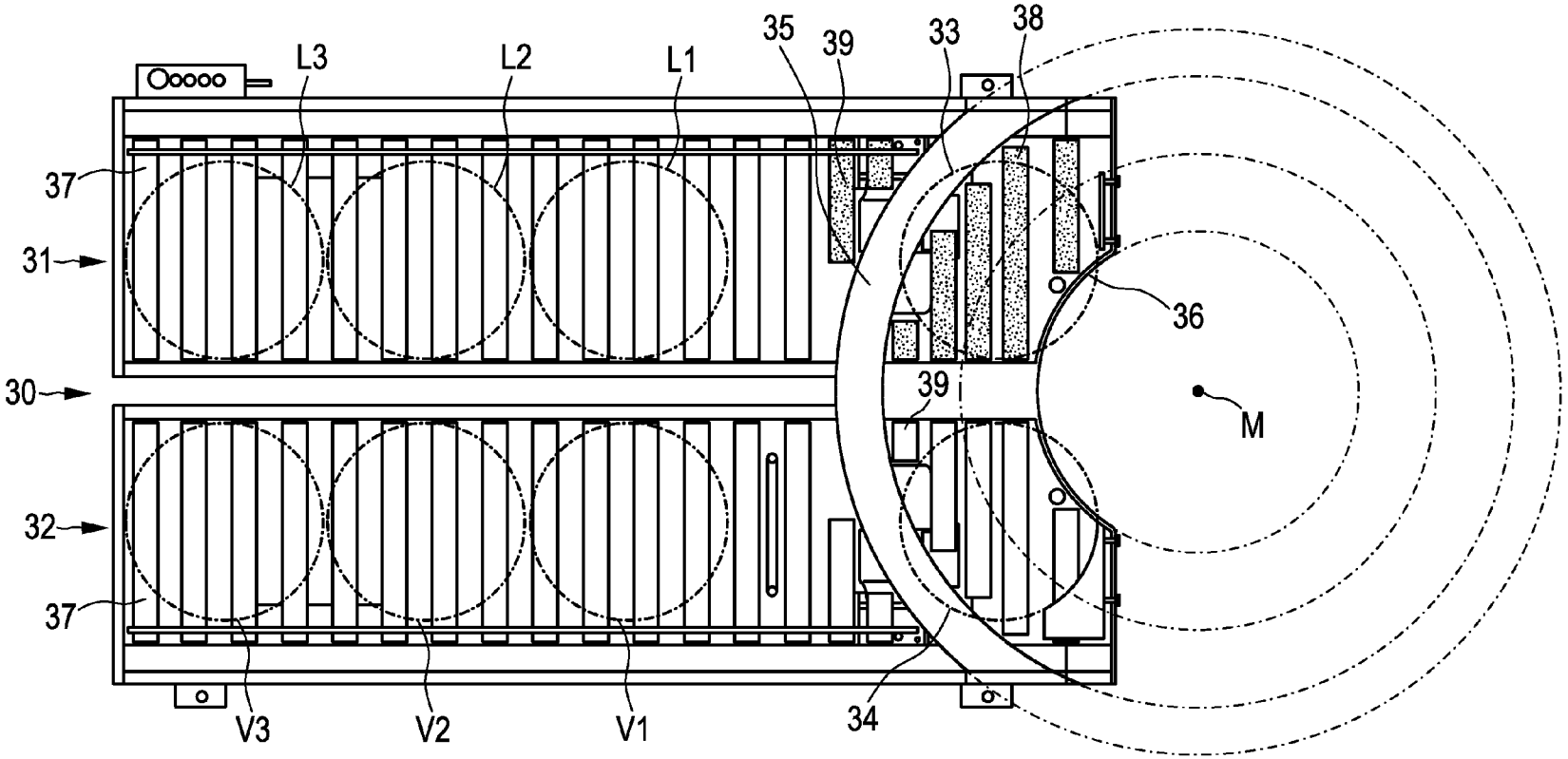
FIG. 3 is a top view onto a conveyor device according to the invention.

Rollers 39 of the two conveyor belts 31, 32 in the area of groove 35 and of shielding plate 36 are correspondingly shortened, as shown in FIG. 3 in the top view onto conveyor device 30, where swivel fork 10 is only indicated by the movement radii of its single components. This shortening of rollers 39 does not, however, adversely affect bringing empty bobbins L1, L2 safely to empty bobbin storage site 33 or taking full bobbins V1, V2 safely away from full bobbin storage site 34, as the area of support for the bobbin flanges on the respective conveyor belt is still sufficiently large.

In this way, the two conveyor belts 31, 32 interpenetrate with the movement space of swivel fork 10. Thus, swivel fork 10 can "drive into" conveyor belts 31, 32 and can pick a bobbin up from empty storage site 33 or from full bobbin storage site 34 there by lifting swivel fork 10, or can put a bobbin down there by lowering swivel fork 10.

As swivel fork 10 can freely be swiveled relative to processing device 40, swivel fork 10 can be swiveled in such a way that any of left or right bobbin receiving sites 21, 22—in a vertical projection—can substantially be matched with spooling site 41 or with empty bobbin storage site 33 or with full bobbin storage site 34.

For the following exemplary description of the course of a bobbin change, it is assumed that a full bobbin S is located on spooling site 41 of processing device 40 and that swivel fork 10 is in a swivel position between empty bobbin belt 31 and processing device 40 (approximately as shown in FIG. 1).

The course of a bobbin change, which in the present configuration of the processing facility consists of the exchange of full bobbin S against empty bobbin L1, then comprises the following sequence of steps:

1. Moving empty bobbin L1 towards empty bobbin storage site 33 by conveyor device 30, so that empty bobbin L1 is standing on empty bobbin storage site 33;
2. Lowering swivel fork 10 to height position BOTTOM;
3. Swiveling swivel fork 10 counterclockwise below empty bobbin belt 31, so that left bobbin receiving site 21 matches empty bobbin storage site 33;
4. Lifting the swivel fork to height position MIDDLE and thus picking empty bobbin L1 up onto left bobbin receiving site 21;
5. Swiveling swivel fork 10 clockwise, so that right bobbin receiving site 22 of swivel fork 10 matches spooling site 41;
6. Lifting swivel fork 10 to height position TOP and thus picking full bobbin S up onto right bobbin receiving site 22;
7. Swiveling swivel fork 10 clockwise, so that left bobbin receiving site 21 of swivel fork 10 matches spooling site 41;
8. Lowering swivel fork 10 to height position MIDDLE and thus putting empty bobbin L1 down onto spooling site 41;
9. Swiveling swivel fork 10 clockwise, so that right bobbin receiving site 22 of swivel fork 10 matches full bobbin storage site 34;
10. Lowering swivel fork 10 to height position BOTTOM and thus putting full bobbin S down onto full bobbin storage site 34;
11. Moving bobbin S away from full bobbin storage site 34 by conveyor device 30.

As it is apparent from the described course of events, swivel fork 10 must be swiveled only by a small angle, namely the angle between right bobbin receiving site 22 and left bobbin receiving site 21, between picking full bobbin S up from spooling site 41 and putting empty bobbin L1 down onto spooling site 41. This results in an only very short period of time in which no bobbin is standing on spooling site 41, which is identical to the machine idle time of processing device 40.

LIST OF REFERENCE SIGNS

1 Bobbin changing device
10 Swivel fork
11 Fork shaft
12 Outer fork bow
13 Inner fork bow
14 Outer left fork section
15 Outer right fork section
16 Inner left fork section
17 Inner right fork section
**14*a*-17*a*** Recesses in the fork sections
18 Fork mounting plate
19 Outer fork bow fixing bar
20 Inner fork bow fixing bar
21 Left bobbin receiving site
22 Right bobbin receiving site
23 Screw
30 Conveyor device
31 Empty bobbin belt
32 Full bobbin belt
33 Empty bobbin storage site
34 Full bobbin storage site
35 Groove for outer fork bow
36 Shielding plate for inner fork bow
37 Roller
38 Rubberized roller
39 Shortened roller
40 Processing device
41 Spooling site
M Pivot of swivel fork
L1, L2, L3 Empty bobbins
V1, V2, V3 Full bobbins
S Bobbin

The invention claimed is:

1. Bobbin changing device for feeding bobbins to and/or removing bobbins from a processing device which can wind a strand-form material onto a bobbin and/or from a bobbin, the bobbin changing device comprising:

at least one conveyor device, and a swivel fork which is suited for feeding bobbins to and/or removing bobbins from the processing device and for feeding bobbins to and/or removing bobbins from the conveyor device, wherein the swivel fork is a rigid component having first and second bar elements and a fork shaft, wherein the first bar elements is fixed to at least one fixing bar on a distal end of the fork shaft and the second bar element is fixed to at least one mounting bar on a proximal end of the fork shaft or to at least one mounting bar on a fork mounting plate at a proximal end of the fork shaft, the first and second bar elements being spaced in a fixed position relative to each other to form a bobbin receiving site on the swivel fork on which the bobbin can stand, and wherein the swivel fork can be swiveled about a swivel axis which is oriented vertically.

2. Bobbin changing device according to claim 1, wherein at least two bobbin receiving sites are formed on the swivel fork.

3. Bobbin changing device according to claim 1, wherein the swivel fork can be positioned relative to the processing device, which further has a spooling site onto which a bobbin can be placed, in such a way that the at least one bobbin receiving site can substantially be matched with the spooling site of the processing device in a vertical projection by swiveling the swivel fork.

4. Bobbin changing device according to claim 1, wherein at least one bobbin storage site is formed in the area of the processing device on which a bobbin can stand, the conveyor device being able to move a bobbin towards the bobbin storage site and/or to move a bobbin away from the bobbin storage site.

5. Bobbin changing device according to claim 4, wherein the at least one bobbin receiving site of the swivel fork can substantially be matched with at least one bobbin storage site of the conveyor device in a vertical projection by swiveling the swivel fork.

6. Bobbin changing device according to claim 1, wherein the vertical position of the swivel fork can be changed.

7. Bobbin changing device according to claim 6, wherein at least in a lowermost height position of the swivel fork, a surface of the at least one bobbin receiving site of the swivel fork is at the same height as or below a surface of the conveyor device.

8. Bobbin changing device according to claim 1, wherein the conveyor device and a movement space of the swivel fork at least partially interpenetrate each other, wherein the movement space of the swivel fork is a volume in which some point of the swivel fork can lie over all possible swiveling positions in connection with all possible height positions of the swivel fork.

9. Processing facility for processing a strand-form material, the processing facility comprising:

a processing device which can wind the strand-form material onto a bobbin and/or from a bobbin, and a bobbin changing device comprising at least one conveyor device, and a swivel fork which is suited for feeding bobbins to and/or removing bobbins from the processing device and for feeding bobbins to and/or removing bobbins from the conveyor device, wherein the swivel fork is a rigid component having first and second bar elements and a fork shaft, wherein the first bar element is fixed to at least one fixing bar on a distal end of the fork shaft and the second bar element is fixed to at least one mounting bar on a proximal end of the fork shaft or to at least one mounting bar on a fork mounting plate at a proximal end of the fork shaft, the first and second bar elements being spaced in a fixed position relative to each other to form at least one bobbin receiving site on the swivel fork on which the bobbin can stand, the and wherein the swivel fork can be swiveled about a swivel axis which is oriented vertically.

10. Bobbin changing method for execution on a processing facility and for feeding bobbins to and/or removing bobbins from a processing device, the method comprising one or more of the following operations in an arbitrary order and/or in an arbitrary number of repetitions, in a processing facility comprising a processing device which can wind a strand-form material onto a bobbin and/or from a bobbin, and the processing facility further comprising a bobbin changing device comprising at least one conveyor device, and a swivel fork which is suited for feeding bobbins to and/or removing bobbins from the processing device and for feeding bobbins to and/or removing bobbins from the conveyor device, wherein the swivel fork is a rigid component having first and second bar elements and a fork shaft, wherein the first bar element is fixed to at least one fixing bar on a distal end of the fork shaft and the second bar element is fixed to at least one mounting bar on a proximal end of the fork shaft or to at least one mounting bar on a fork mounting plate at a proximal end of the of the fork shaft, the first and second bar elements being spaced in a fixed position relative to each other to form a bobbin receiving site on the swivel fork on which the bobbin can stand, the swivel fork can be swiveled about a swivel axis which is oriented vertically:

moving the conveyor device towards a bobbin storage site of the conveyor device by a certain distance;

moving the conveyor device away from a bobbin storage site of the conveyor device by a certain distance;

swiveling the swivel fork about the swivel axis by a certain angle in a certain direction;

lifting the swivel fork by a certain distance;

lowering the swivel fork by a certain distance.

* * * * *